United States Patent [19]

Downing

[11] Patent Number: 4,793,295

[45] Date of Patent: Dec. 27, 1988

[54] RETAINER FOR A HYDRAULIC LASH ADJUSTER

[75] Inventor: Todd R. Downing, Glen Ellyn, Ill.

[73] Assignee: Stanadyne, Inc., Windsor, Conn.

[21] Appl. No.: 669,343

[22] Filed: Nov. 8, 1984

[51] Int. Cl.[4] ..... F01L 1/24

[52] U.S. Cl. ..... 123/90.5; 123/90.55

[58] Field of Search ..... 123/90.46, 90.5, 90.55, 123/90.56, 90.57, 90.58, 90.59

[56] References Cited

U.S. PATENT DOCUMENTS

| | | | |
|---|---|---|---|
| 1,977,778 | 10/1934 | Rice | 123/90.55 |
| 3,516,393 | 6/1970 | Dadd | 123/90.55 |
| 4,227,495 | 10/1980 | Krieg | 123/90.55 |
| 4,291,652 | 9/1981 | Trzoska | 123/90.55 X |
| 4,326,484 | 4/1982 | Amrheim | 123/90.5 |
| 4,361,120 | 11/1982 | Kueny | 123/90.5 X |
| 4,402,285 | 9/1983 | Arai et al. | 123/90.46 X |
| 4,448,155 | 5/1984 | Hillebrand et al. | 123/90.5 |

*Primary Examiner*—Ira S. Lazarus
*Assistant Examiner*—Peggy Neils
*Attorney, Agent, or Firm*—Kinzer, Plyer, Dorn, McEachran & Jambor

[57] ABSTRACT

A hydraulic lash adjuster has a generally cylindrical, hollow body having a closed end, an open end and a top land at the open end. A plunger is positioned in the body and is held in place by a retainer. The retainer is fastened to the exterior of the body. The retainer has a rim supported on the top land of the body and is held in place by tabs which are folded under into grooves in the side of the body.

4 Claims, 1 Drawing Sheet

Fig. 1.
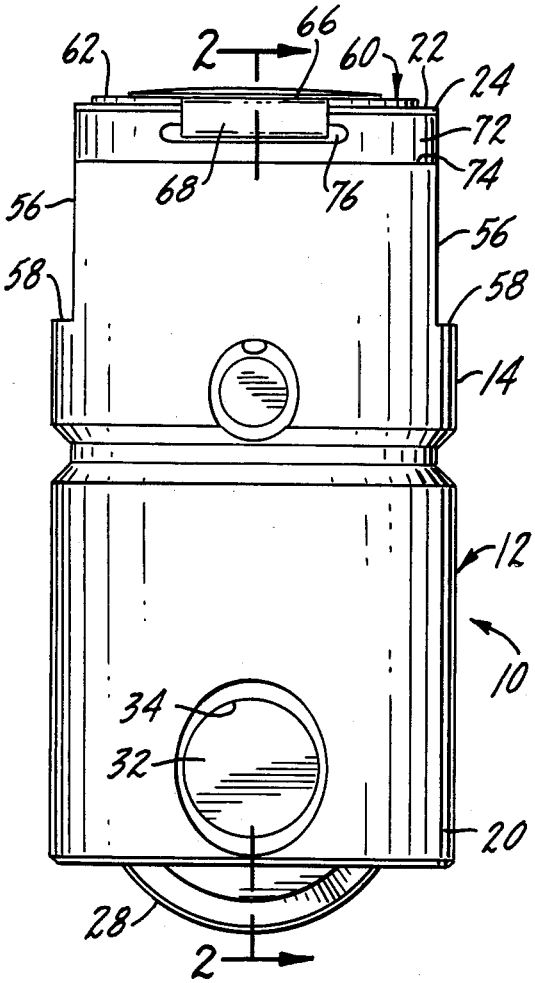
Fig. 2.
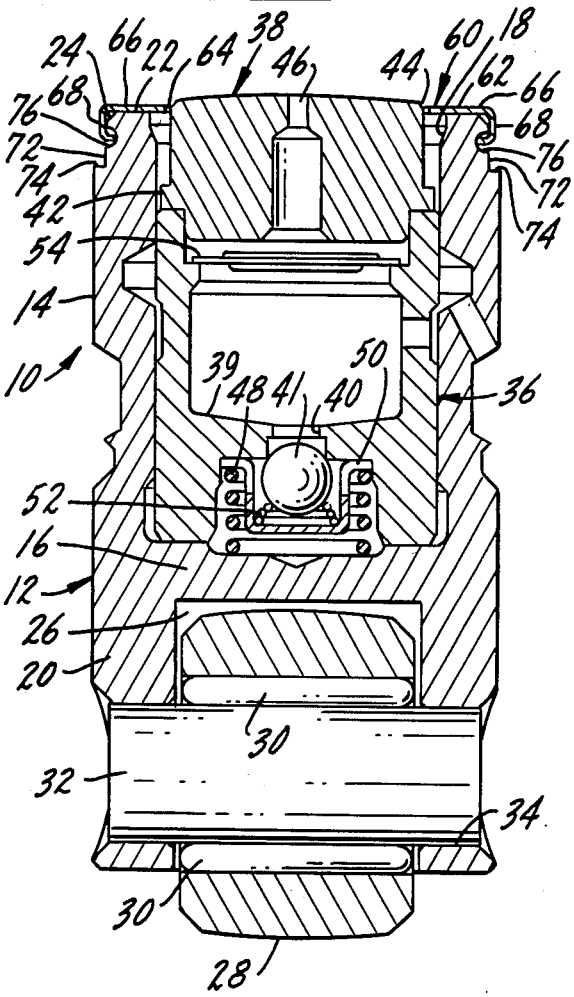
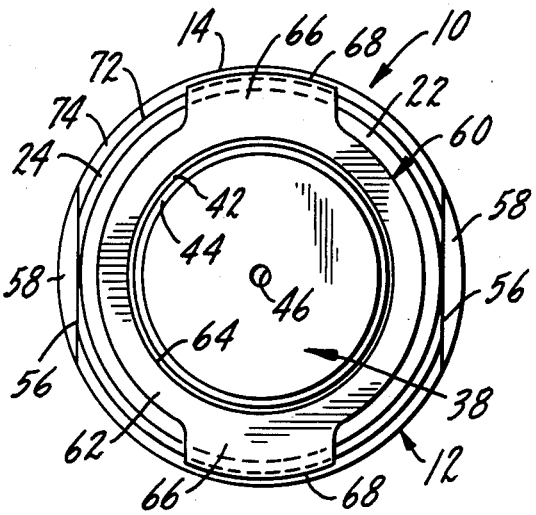
Fig. 3.
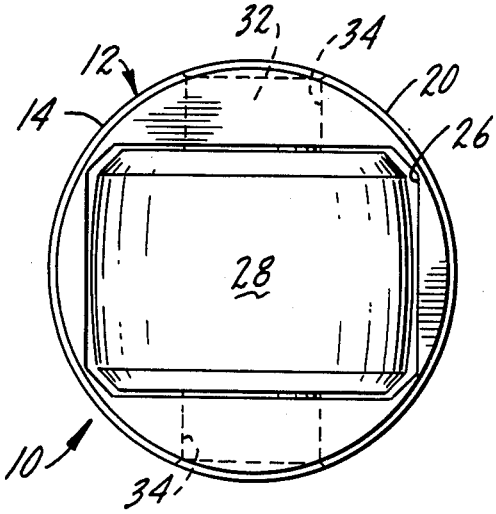
Fig. 4.

RETAINER FOR A HYDRAULIC LASH ADJUSTER

SUMMARY OF THE INVENTION

This invention relates to hydraulic lash adjusters and is particularly concerned with a retainer for holding the plunger assembly in the lash adjuster body.

A primary object of the invention is a retainer which can be mounted externally on the body.

Another object of the invention is a retainer which does not interfere with the operation of non-rotation means on the outside of the body.

Another object of the invention is a retainer which does not interfere with the precision hydraulic portions of the lash adjuster.

Another object of the invention is a retainer of the type described which has sufficient strength and durability to withstand the rigors of engine operation and rough handling in shipping.

Another object of the invention is a retainer which is easily assembled and disassembled.

Other objects may become apparent in the following drawings, description and claims.

BRIEF DESCRIPTION OF THE DRAWINGS

FIG. 1 is a side elevation view of a hydraulic lash adjuster according to the invention.

FIG. 2 is a section taken along line 2—2 of FIG. 1.

FIG. 3 is a top plan view of a lash adjuster having the retainer of the present invention.

FIG. 4 is a bottom plan view of the hydraulic lash adjuster.

DETAILED DESCRIPTION OF THE INVENTION

Hydraulic tappets and hydraulic valve lifters both perform a lash adjustment function. There is also an engine valve train component which only adjusts lash and does not perform a valve lifting function. The term "lash adjuster" will be used herein to describe all such devices and is meant to include devices which perform a valve lifting function as well as a device which is a part of the valve train but which only performs a lash adjusting function.

FIGS. 1–4 show a hydraulic roller tappet 10 having a body 12. The body is generally cylindrical and hollow. It includes a cylindrical wall 14, an intermediate wall 16, an open end 18 and a skirt portion 20. The end of the wall 14 at the open end 18 defines a top land 22. The top land is chamferred at 24. The skirt portion 20 defines a cavity 26 in which is located a roller assembly. The roller assembly includes a roller 28 and needle bearings 30 mounted on a roller pin 32. The pin is carried in openings 34 in the skirt 20. The ends of the pin are staked to hold it in the openings 34.

Disposed in the body is a plunger assembly. The plunger assembly includes an interior plunger member 36 and a plunger cap 38. The interior plunger member 36 is hollow and has a closed end 39 with a passage 40 sealed by a check valve 41. The plunger cap 38 has a shoulder 42 engaging the upper end of the interior plunger member 36. The top of the plunger cap is chamferred at 44. The plunger cap 38 has an opening 46 which permits external fluid to enter the plunger interior chamber.

A high pressure chamber is defined between the body wall 16 and the plunger closed end 39. A plunger spring 48 is disposed in the high pressure chamber. The plunger spring 48 rests on the body wall 16 and urges a valve retainer 50 into contact with the bottom of the interior plunger member 36. The valve retainer 50 supports a coil spring 52 which in turn urges the check valve 41 into sealing engagement with the closed end 39 of the plunger. The check valve 41 seals the passage 40. There may also be a metering valve 54 in the interior chamber of the plunger. The body 12 and plunger assembly have various ports, passages and grooves which perform the hydraulic functions of the lash adjuster. These form no part of the present invention and will not be described in detail.

Since this is a hydraulic roller tappet, non-rotation means are provided to maintain proper orientation of the roller during operation. In the illustrated embodiment the non-rotation means take the form of a pair of opposed flats formed on the exterior of the body. The flats are defined by flat faces 56 which extend from the open end of the body to ledges 58. The flat faces engage cooperating elements in the engine block to prevent rotation of the tappet body.

A retainer shown generally at 60 holds the plunger assembly in the body. The retainer is preferably made of S.A.E. 1060-1095 spring steel. The retainer includes a rim 62 with a central opening 64. The opening 64 of the retainer 60 is sized to permit the plunger cap 38 to fit therethrough but the shoulder 42 of the cap will not fit through the open-ing. Thus, the rim 62 is engageable with the shoulder 42 of the plunger cap to hold the plunger assembly in the body. The retainer also has a pair of integral tabs 66 which are folded under as at 68. The tabs reside in arcuate recesses formed in the open end of the body wall 14. The recesses are defined by faces 72 and shoulders 74. A pair of slots 76 are cut in the faces 72 of the recesses. The slots receive the folded-under portion 68 of the retainer tabs 66.

It can be seen that the retainer 60 is mounted externally of the body and hence, it will not take up space from the precision hydraulic portions internal to the tappet assembly. At the same time, the externally mounted retainer does not interfere with the non-rotation means which are necessary in a roller tappet. This is because of the fact that the retainer rim 62 rests on the top land 22 of the body and the tabs 66 are circumferentially spaced from the flats 56. Further, the tabs' folded-under sections 68 reside within the recesses and thus do not extend beyond the outside diameter of wall 14. This is best seen in FIG. 3. A further advantage of the retainer is the ease with which it can be assembled and disassembled. The slots 76 are chordal slots, i.e., they are cut straight across the faces 72. This permits the installation of the retainer by sliding it and its folded-under portions 68 in a direction perpendicular to the axis of the body.

Whereas the retainer has been shown and described in connection with a hydraulic roller tappet, it will be understood that the invention is not to be limited to roller tappets. The retainer can be applied to any design that requires a compact retention means.

Accordingly, while a specific embodiment of the invention has been shown and described, it will be understood that the invention is not limited to the specific showing but that many modifications and alterations could be made thereto without departing from the scope of the following claims.

I claim:

1. A hydraulic roller tappet, comprising a generally cylindrical, hollow body having an open end and a top land at the open end, a plunger positioned in the body, a roller mounted for rotation in the body opposite the open end, non-rotation means formed on the body for maintaining proper orientation of the roller including at least one flat formed on the exterior of the body, and a retainer for holding the plunger in the body, the retainer comprising a rim held on the top land by tabs which engage the exterior of the body, the rim being engageable with the plunger, said tabs being circumferentially spaced from said non-rotation flat.

2. The structure of claim 17 further comprising recesses on the outside of the body accommodating the tabs such that the tabs reside within the outside diameter of the body.

3. The structure of claim 2 further comprising slots cut in the recesses, the tabs being folded under to engage the slots.

4. The structure of claim 1 wherein the non-rotation means comprises two opposed flats formed on the exterior of the body and further comprising two arcuate, opposed recesses extending partially around the outside of the body from one flat to the other, the recesses accommodating the tabs such that the tabs reside within the arc of the recesses and within the outside diameter of the body.

* * * * *